United States Patent [19]

Previato et al.

[11] Patent Number: 5,004,431

[45] Date of Patent: Apr. 2, 1991

[54] REINFORCED CONNECTOR LATCH

[75] Inventors: Mario Previato; Silvio Barbieri; Roberto Martucci, all of Padova, Italy

[73] Assignee: Molex Incorporated, Lisle, Ill.

[21] Appl. No.: 428,080

[22] Filed: Oct. 27, 1989

Related U.S. Application Data

[63] Continuation-in-part of Ser. No. 306,718, Feb. 6, 1989, Pat. No. 4,900,263.

[51] Int. Cl.[5] ..... H01R 13/627

[52] U.S. Cl. ..... 439/358; 439/372; 439/594

[58] Field of Search ..... 439/353, 357, 358, 351, 439/352, 371, 372, 376, 592, 594, 596, 347, 629, 630, 635

[56] References Cited

U.S. PATENT DOCUMENTS

| | | | |
|---|---|---|---|
| 2,235,020 | 3/1941 | Jones | 439/358 |
| 3,544,951 | 12/1970 | Roberts | 439/358 |
| 3,933,406 | 1/1976 | Cameron et al. | 439/358 |
| 4,026,624 | 5/1977 | Boag | 439/357 |
| 4,273,403 | 6/1981 | Cairns | 439/357 X |
| 4,392,706 | 7/1983 | Baker et al. | 439/353 |
| 4,405,192 | 9/1983 | Eaby et al. | 439/358 |
| 4,838,810 | 6/1989 | Yoshimura et al. | 439/358 |
| 4,842,542 | 6/1989 | Davis | 439/357 |
| 4,857,008 | 8/1989 | Kee et al. | 439/358 X |
| 4,917,625 | 4/1990 | Haile | 439/358 |

FOREIGN PATENT DOCUMENTS

| | | | |
|---|---|---|---|
| 652140 | 10/1937 | Fed. Rep. of Germany | 439/357 |
| 2352419 | 12/1977 | France | 439/357 |

*Primary Examiner*—Z. R. Bilinsky

*Attorney, Agent, or Firm*—Louis A. Hecht; Stephen Z. Weiss; A. A. Tirva

[57] ABSTRACT

A reinforced latch structure for electrical connectors is provided. The latch structure comprises at least one latch on one connector in a mateable pair which is resiliently deflectable about a first axis and which is disposed to contact a cam on the opposed connector during mating. The deflectable latch and/or the cam on the opposed connector define a leading ramp surface, a trailing ramp surface and a locking surface. The leading ramp surface is disposed to resiliently deflect the latch arm and develop stored energy therein. The trailing ramp surface employs the stored energy developed in the latch arm to urge the connectors toward a fully mated condition. The latch arm includes a spring steel wire insert for reinforcement, such that the plastic latch arm does not become permanently deformed. The connectors may be disengaged from one another by biasing the latch arm about a second axis away from the associated connector a sufficient amount to clear the cam and enable disengagement of the connectors.

16 Claims, 12 Drawing Sheets

REINFORCED CONNECTOR LATCH

CROSS-REFERENCE TO RELATED APPLICATION

This application is a continuation-in-part of application Ser. No. 07/306,718, filed Feb. 6, 1989, now U.S. Pat. No. 4,900,263.

BACKGROUND OF THE INVENTION

Electrical connectors comprise nonconductive housings in which one or more electrically conductive terminals are mounted. The terminals are mechanically and electrically joined to conductive leads, such as Wires, cables or conductive areas on a circuit board. Electrical connectors are employed in mateable pairs, wherein the respective housings and terminals in a pair are mateable With one another. Thus, for example, a pair of electrical connectors may enable electrical connections between the conductors of a cable and the printed circuits on a board.

The mateable terminals in a pair of electrical connectors are specifically designed to achieve substantial contact forces against one another in their fully mated condition. These necessary contact forces can result in significant insertion forces during mating, particularly as the number of terminals in a connector increases.

The existence of high insertion forces creates the possibility that the person Who mates two electrical connectors will stop short of complete insertion. Incomplete insertion of mated connectors typically Will yield less than specified contact forces between the mated terminals and can result in poor electrical performance or unintended separation of the partly mated connectors, particularly in a high vibration environment such as an automobile.

To help ensure complete insertion and to prevent unintended separation of mated connectors, many electrical connector housings are provided with interengageable locks. In particular, one connector may comprise a deflectable latch, while the opposed mateable connector may comprise a locking structure for engagement by the latch. Most prior art connectors with deflectable latches and corresponding locking structures can lockingly retain connectors in their mated condition, but require complex manipulation to achieve mating or unmating. The above described high insertion forces in combination with the manipulation required for the locking means in prior art connectors can make mating and unmating particularly difficult.

The prior art includes ramped locking structures which are intended to assist in the complete insertion of the connectors. In particular, the prior art includes connectors where a deflectable latch on one connector and a corresponding locking structure on the mateable connector are constructed such that the resiliency of the latches and the angular alignment of the ramps cooperate to urge the connectors toward a fully mated condition. Examples of prior art connectors With this general construction are shown in U.S. Pat. No. 4,026,624 which issued to Boag on May 31, 1977 and U.S. Pat. No. 4,273,403 which issued to Cairns on June 16, 1981. In these and other similar prior art connectors, the unmating of connectors is rendered difficult by the need to overcome both the contact forces in the terminals and the ramping forces in the latches of the housing. Thus, although these prior art connectors may facilitate the mating of connectors, they require substantially greater forces for unmating.

The manipulation of these prior art connectors is rendered even more difficult by the complex plural deflections that are required within the latch structures both during mating and during unmating. In particular, prior art connectors of this type have required latch structures that gradually deflect about plural axes during mating and unmating, such as a deflection toward or aWay from the adjacent plane of the connector housing and a deflection parallel to the plane. The excessive forces required for such mating or unmating may be sufficient to damage adjacent parts of the connector, such as the fragile electrical connections between terminals and leads therein. Furthermore, many of the prior art connectors of this type, such as the connectors shown in U.S. Pat. No. 4,026,624, do not provide adequate locking of the connector components in the fully seated condition thereof. Thus, a less than fully mated condition or an accidental unmating is possible.

Prior art latch structures are typically constructed as an integral part of the connector housings, i.e., the housings and latch structures are commonly molded from the same plastic material. However, all plastics will eventually be deformed or yield their shape when submitted to a continuous load. This is particularly true for nylon, which loses its resiliency over time or temperature. Accordingly, prior art latch structures also lose their effectiveness for assisting in the final mating of the connectors.

In view of the above, it is an object of the subject invention to provide a positive latch structure for electrical connectors to ensure complete mating thereof.

It is another object of the subject invention to provide electrical connectors that assist in the final mating thereof and that ensure positively latched engagement in a fully mated condition.

An additional object of the subject invention is to provide electrical connectors that can achieve unmating without the need to overcome ramping forces of deflectable latch components in the housing.

Still another object of the subject invention is to provide electrical connectors where deflectable latches undergo only simple deflection about a single axis during mating and a simple deflection about a different axis during unmating, while still achieving positive locking in the fully mated condition.

A further object of the subject invention is to provide an improved latch structure for electrical connectors which does not lose its resiliency under a continuous load.

SUMMARY OF THE INVENTION

The subject invention is directed to a pair of mateable electrical connectors. Each connector comprises a nonconductive housing which may be molded from a plastic material. At least one electrical terminal is mounted in each said housing, with each terminal in one housing being mateable with a corresponding terminal in the opposed housing to provide electrical connection therebetween.

The respective housings are constructed to be lockingly but releasably retained in a position corresponding to a fully mated condition of the respective terminals. More particularly, the housing of at least one connector may comprise deflectable latch means which may be disposed and configured for lockingly but releasably engaging a corresponding cam on the opposed housing.

The deflectable latch means of at least one housing is resilient to enable stored energy to be developed by the initial deflection which occurs during mating of the electrical connectors. The configuration of the respective cam and latch means also is such that the stored energy developed by the initial deflection of the latch means is employed during later stages of mating to urge the respective connectors into their fully mated condition. The stored energy may be developed and subsequently employed by appropriately configured ramping surfaces on the latch means and/or the cam. The ramping surfaces may be disposed to achieve deflection of the latch means about a first axis extending generally orthogonal to the direction of mating movement of the respective connectors. The ramping surfaces may define planes parallel to the first axis of deflection. The latch means may further be configured to achieve secure but releasable locking of the respective connectors in the fully mated condition of the terminals therein.

The latch means may alternately be deflectable about a second axis to enable separation or unmating of the connectors from one another. The second axis of deflectable rotation may be generally orthogonal to the first axis of rotation. The deflectable latch means may be joined to the remainder of the associated housing at a fulcrum or root. The deflectable latch means may extend to opposed sides of the root such that portions of the latch means on one side of the root perform a locking function, while portions of the latch means on the opposed side of the root may be conveniently activated to permit deflection of the latch means about the second axis for disengaging the latch means from the opposed connector. The connectors may alternatively or additionally be constructed to facilitate the use of a disengagement tool, such as a screw driver, to achieve the deflection of the latch means for disengaging the connectors. The above described embodiments enable the connectors to be unmated without overcoming the ramping forces of the latch means and cam. Rather, after the deflection of the latch means about the second axis, it is merely necessary to overcome the contact forces between the terminals mounted in the respective housings.

The latch means may comprise a single deflectable latch arm or a pair of opposed deflectable latch arms. The latch arms may be configured to deflect about opposed sides of a cam on the opposed connector housing. The cam may define a prism of generally pentagonal cross section defined by a pair of opposed ramping faces for developing stored energy in the latch arms, a pair of oppositely directed ramped faces for employing the previously developed stored energy and a locking face. The various faces of the cam may define planes which are parallel to the first axis of deflection of the latch means.

In an alternate embodiment, the deflectable latch means may comprise a pair of deflectable latches that move through a locking gate Which defines the cam. In this embodiment, the ramping and locking faces may be disposed on the deflectable latch arms, and may define planes parallel to the first axis of deflection.

In all of the above described embodiments, the housings may further comprise anti-overstress structures for preventing over-rotation of the deflectable latch arms about either of the alternate axes of rotation.

In still another embodiment, the deflectable latch means may include a metallic spring means for reinforcement. In the exemplary embodiment, the latch arms have a spring steel wire inserted therein such that the latching mechanism doesn't lose its resiliency over time. This reinforced latch structure may be used With or Without locking faces, depending on the particular application. Moreover, the use of spring steel inserts in any type of plastic latch can improve the functionality and consistency of the latch over temperature and aging.

DETAILED DESCRIPTION OF THE PREFERRED EMBODIMENTS

Figure 1:
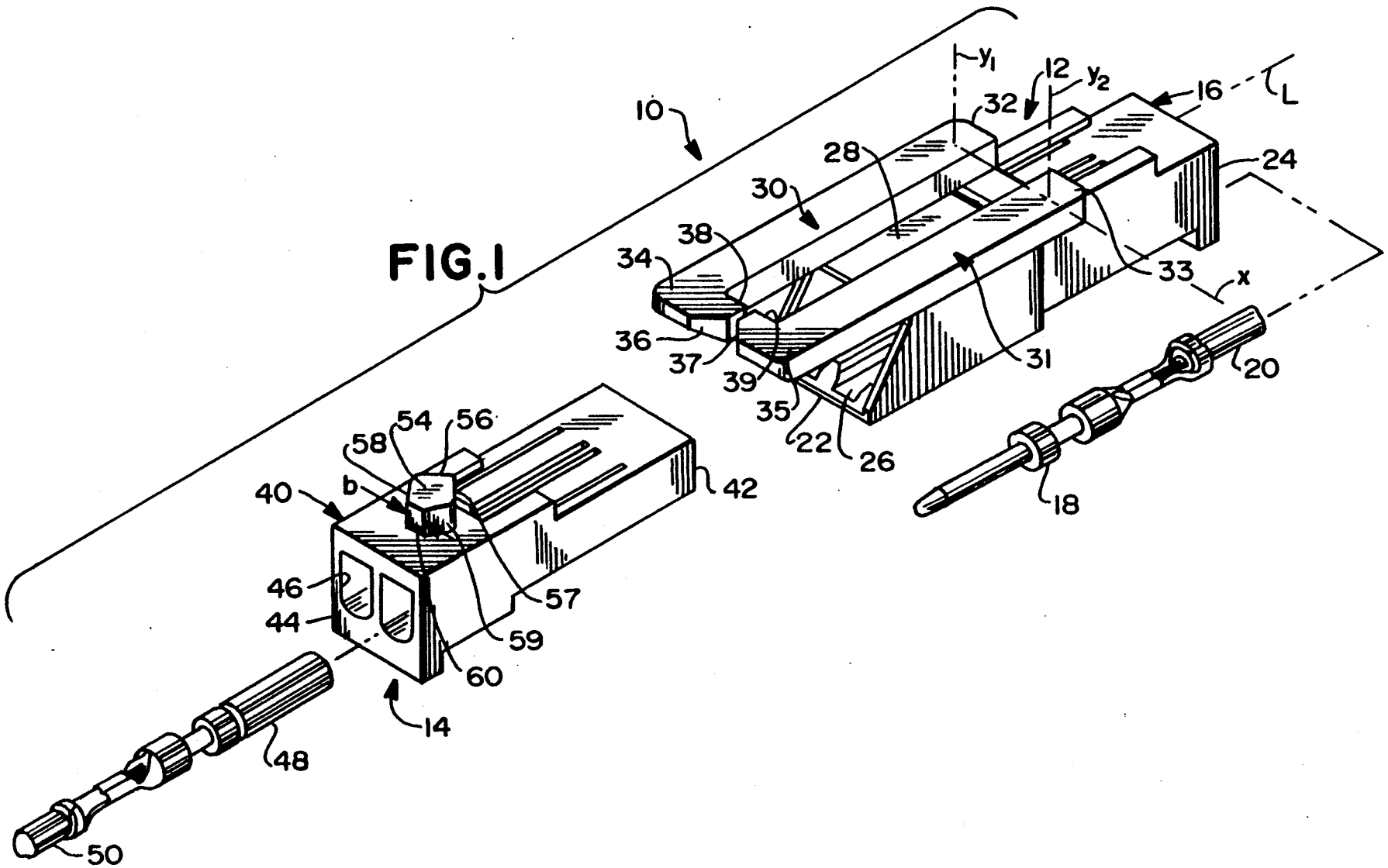
FIG. 1 is an exploded perspective view of a pair of connectors in accordance with the subject invention.
Figure 2:
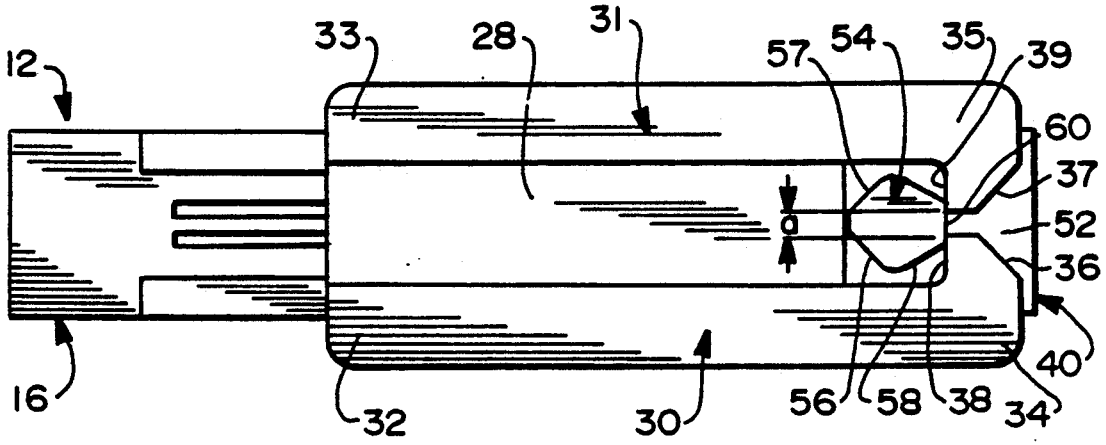
FIG. 2 is a top elevational view of the connectors in a fully mated condition.
Figure 3:
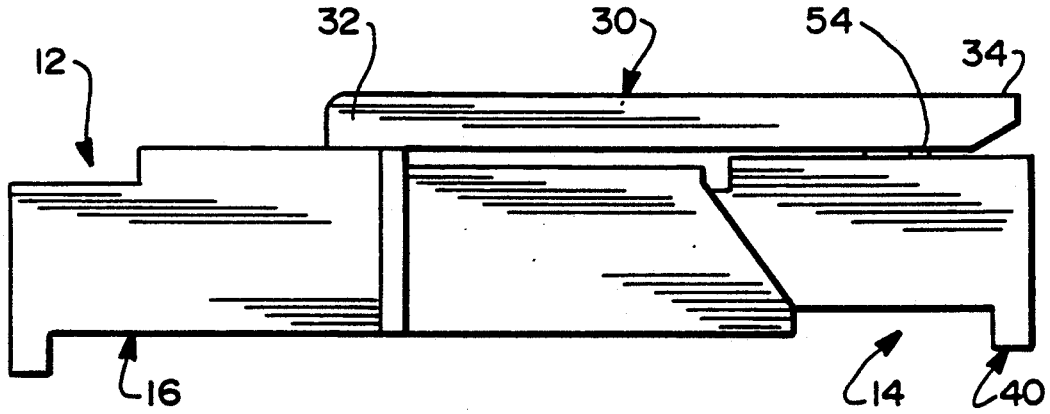
FIG. 3 is a side elevational view of the mated connectors shown in FIG. 2.

A pair of mateable connectors in accordance with the subject invention are illustrated in FIGS. 1-3, and are identified generally by the numeral 10. The pair of mateable connectors comprise a socket connector 12 and a plug connector 14.

Figure 1A:
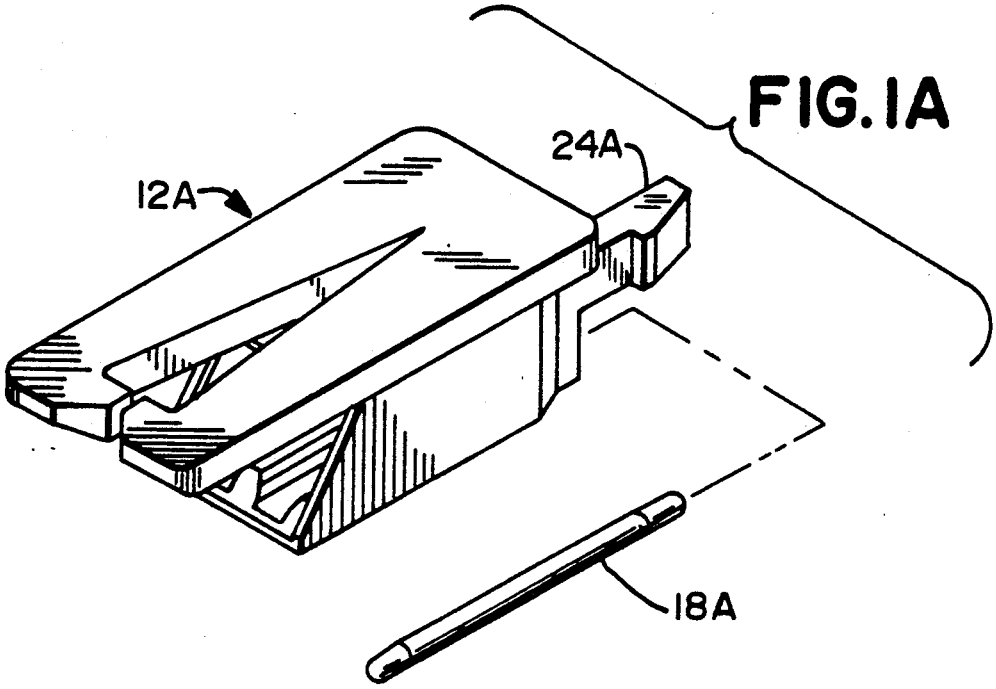
FIG. 1A is a perspective view of an alternate socket connector that can be used with the plug connector in FIG. 1.

The socket connector 12 comprises a molded nonconductive housing 16 having an array of pin terminals 18 secured mounted therein. Each pin terminal 18 is terminated to a wire lead 20. The socket 12 shown in FIG. 1 is adapted to receive a pair of pin terminals 18 therein. However, it is to be understood that the positive connector latch illustrated in FIG. 1 can be adapted for connectors having any number of terminals therein. The socket connector may also be constructed for direct connection to conductive areas on a printed circuit board. In particular, FIG. 1A shows a socket connector 12A constructed to be lockingly mounted to a printed circuit board by latches 24A. The socket connector 12A is adapted to receive pins 18A, one end of which will be connected to conductive traces on the circuit board. Other variations of the socket connector can include right angle pins, with latches on the connector being orthogonal to the latches 24A in FIG. 1A.

The housing 16 of the socket 12 as shown in FIG. 1 is unitarily molded from a plastic material and comprises a forward mating end 22, a rear end 24 and a plug receiving cavity 26 extending therebetWeen and generally along the longitudinal mating axis "L" of the housing 16. The housing 16 further comprises a top surface 28 to which a pair of resiliently deflectable latch arms 30 and 31 are mounted. The latch arms 30 and 31 are cantilevered to the top surface 28 of the housing 16 at the respective rear ends 32 and 33 of the latch arms 30 and 31. The mounting of the latch arms 30 and 31 to the housing 16 is such that the latch arms 30 and 31 can be resiliently deflected in a common plane away from one another and about parallel axes Y1 and Y2 extending generally orthogonal to the top surface 28. Alternatively, the latch arms 30 and 31 can be resiliently deflected away from the top surface 28 of the housing 16 and about axis X extending generally orthogonal to the longitudinal direction of the housing 16 and generally parallel to the plane of the top surface 28.

The latch arms 30 and 31 further comprise forward ends 34 and 35 which are characterized by ramped leading surfaces 36 and 37 which are angularly aligned relative to one another to enable the respective latch arms 30 and 31 to be deflected away from one another. The latch arms 30 and 31 further are provided with rearwardly facing locking surfaces 38 and 39 which are aligned generally orthogonal to the longitudinal mating axis L of the housing 16 and parallel to the axes Y1 and Y2. In the unbiased condition, as shown most clearly in FIGS. 1 and 2, the locking surfaces 38 and 39 are spaced from one another by distance "a". As shown most clearly in FIG. 3, the extreme forward end of each latch arm 30 and 31 may be of reduced thickness to facilitate the insertion of a tool betWeen the latch arms 30 and 31 and a corresponding surface of the plug 14 for deflecting the latch arms 30 and 31 away from the plug 14 as explained further beloW.

The plug 14 comprises a housing 40 which is unitarily molded from a nonconductive material. The housing 40 comprises a forward mating end 42 and an opposed rear end 44 with a plurality of terminal receiving apertures 46 extending therebetween. Pin receiving terminals 48 are terminated to wire leads 50 and are mountable in the terminal receiving apertures 46 of the housing 40. The forWard end 42 of the housing 40 is dimensioned to be slidably inserted into the plug receiving cavity 26 of the housing 16 of the socket 12. In the fully mated condition of the respective housings 16 and 40, the pin terminals 18 of the socket 12 will be fully mated in the pin receiving terminals 48 of the plug 14.

The housing 40 of the plug 14 comprises a top surface 52 having a locking cam 54 extending unitarily therefrom. The locking cam 54 generally defines a prism of pentagonal cross section. The lateral faces of the prismatic locking cam 54 define a pair of leading ramp faces 56 and 57, a pair of trailing ramp faces 58 and 59 and a locking face 60, all of which are disposed to be generally parallel to the first axes Y1 and Y2 of the latch arms 30 and 31 in the mated condition of the connectors 12 and 14.

The leading faces 56 and 57 of the standoff 54 define an angle with respect to the longitudinal mating axis L of the connectors 12 and 14 to achieve an appropriate insertion force in accordance with the relative resiliency of the latch arms 30 and 31. An angle of approximately 45° was selected for the connectors 12 and 14 illustrated herein. The trailing faces 58 and 59 also define an angle with respect to the longitudinal mating axis L of the connectors 12 and 14 which is selected in accordance with the insertion forces in the terminals 18, 48 which must be overcome. Angles of approximately 30° are shown for the terminal connectors herein. The locking face 60 defines a width "b" which exceeds the distance "a" between the locking surfaces 38 and 39 of the latch arms 30 and 31 respectively.

The connectors 12 and 14 are mated by slidably inserting the forward mating end 42 of the plug housing 40 along the mating axis L into the plug receiving cavity 26 at the forward end 22 of the socket housing 16, such that the leading ramp faces 36 and 37 of the latch arms 30 and 31 will engage the leading ramp faces 56 and 57 of the pentagonally cross-sectioned prismatic cam 54. Continued advancement of the socket 12 and plug 14 toward one another will cause the latch arms 30 and 31 to deflect away from one another in view of the wedging forces developed at the opposed ramping surfaces 36/56 and 37/57. This deflection will generate stored energy in the resilient latch arms 30 and 31.

Continued mating of the socket 12 and plug 14 will cause the forward ends 34 and 35 of the latch arms 30 and 31 respectively to pass the leading ramp faces 56 and 57 of the prismatic locking cam 54 and to engage the trailing ramp faces 58 and 59 respectively. This substantially corresponds to the point at which the pin terminals 18 engage the pin receiving terminals 48. In this position, the stored energy generated by the resilient deflection of the latch arms 30 and 31 will cause the latch arms 30 and 31 to cooperate with the trailing ramp faces 58 and 59 to effectively pull the socket 12 and plug 14 toward one another and into relative dispositions corresponding to complete mating of the pin terminal 18 With the pin receiving terminal 48. As the forward ends 34 and 35 of the latches 30 and 31 reach the rear ends of the trailing ramp faces 58 and 59, the latch arms 30 and 31 will resiliently return to their unbiased condition with the locking surfaces 38 and 39 of the latch arms 30 and 31 respectively lockingly engaging the locking face 60 of the prismatic locking cam 54. This relative position of the latch arm% 30 and 31 with the locking cam 54 corresponds to a fully mated condition of the pin terminals 18 in the pin receiving terminals 48. It will be noted that the interengagement of the locking surfaces 38 and 39 and the locking face 60 of the cam 54 will prevent unmating of the socket 12 and plug 14 by opposed pulling forces exerted thereon. Rather, as shown most clearly in FIG. 3, unmating can only be achieved by inserting an appropriate tool, such as a screwdriver, between the tapered leading ends 34 and 35 of the latch arms 30 and 31 and the opposed top surface 52 of the plug housing 40. The tool could be rotated to cause the latch arms 30 and 31 to be biased about the alternate axis X and aWay from the top surface 52 a sufficient amount to enable the locking surfaces 38 and 39 of the latch arms 30 and 31 to clear the locking face 60 of the cam 54. In this deflected condition, unmating can be achieved easily by unmating forces sufficient only to overcome the contact forces between the respective pin terminals 18 and pin receiving terminals 48.

Figure 2A:
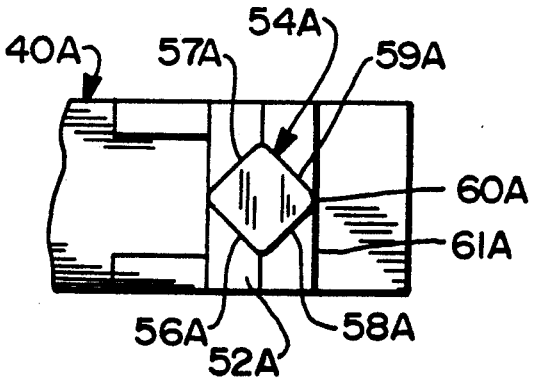
FIG. 2A is a top elevational view of an alternate plug connector that could be used in the connector assembly of FIG. 2.
Figure 3A:
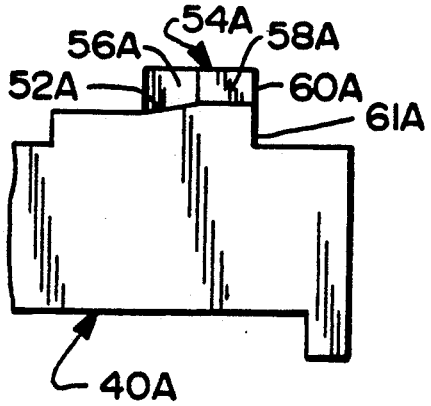
FIG. 3A is a side elevational view of the plug connector of FIG. 2A.

An alternate plug connector housing 40A is depicted in FIGS. 2A and 3A. The housing 40A includes a top surface 52A from which a cam 54A extends. The cam 54A includes leading ramp faces 56A and 57A, trailing ramp faces 58A and 59A and a rear edge 60A of substantially zero width. Thus, the cam 54A is a prism of generally rhomboidal cross section. The portion of the top surface 52A in line with the leading ramp faces 56A and 57A is ramped to achieve a slight upward deflection of the latch arms during early stages of mating. A locking surface 61A is defined on the top surface 52A in line With the rear edge 60A of the cam 54A. The latch arms will deflect downwardly upon complete insertion to engage the locking surface 61A.

Figure 4:
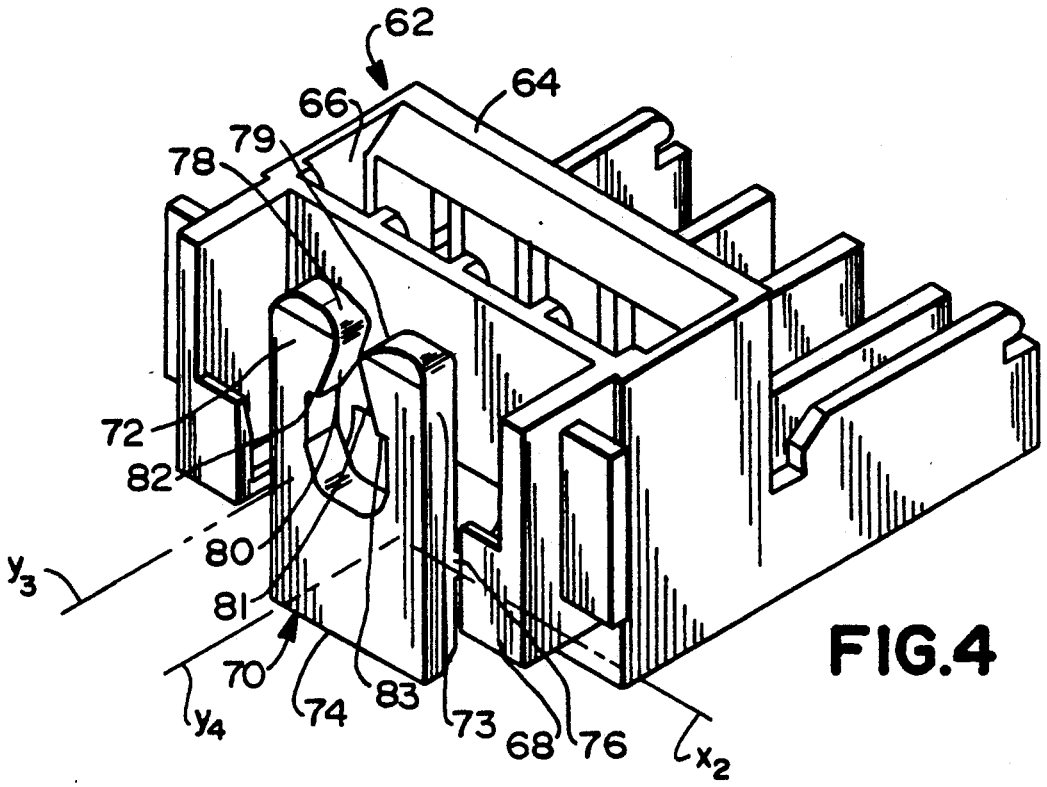
FIG. 4 is a perspective view of an alternate connector housing in accordance with the subject invention.
Figure 5:
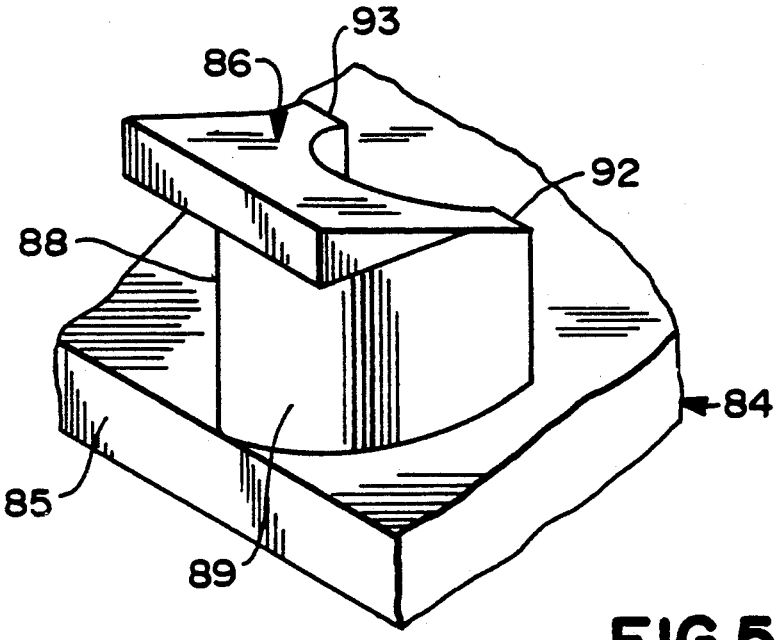
FIG. 5 is a perspective view of a portion of a second connector housing for locking engagement with the housing of FIG. 4.

An alternate lock and standoff construction is shown in FIGS. 4–9. In particular, FIG. 4 shows a housing 62 for an electrical connector socket. The housing comprises a front mating face 64 having a plug receiving cavity 66 extending therein. The connector housing 62 comprises a top wall 68 from which a resiliently deflectable latch structure 70 extends. More particularly, the latch structure 70 includes a pair of opposed latch arms 72 and 73 Which are resiliently deflectable about axes Y3 and Y4 away from one another. The latch structure 70 further comprises an opposed rear end 74. The connection of the latch structure 70 to the remainder of the housing 62 is defined by a root 76 intermediate the latch arms 72, 73 and the opposed rear end 74. Thus, the entire latch structure 70 may be deflected at the root 76 to permit rotation of the latch structure 70 about axis X2 and relative to the remainder of the housing 62. For example, the rear end 74 of the latch structure 70 may be urged toward the top surface 68 of the housing 62, thereby causing the latch arms 72 and 73 to be rotated generally about axis X2 away from the remainder of the housing 62.

The latch arms 72 and 73 comprise leading ramp surfaces 78 and 79 and trailing ramp surfaces 80 and 81 which are parallel to axes Y3 and Y4. The latch arms further comprise rearwardly facing locking surfaces 82 and 83 respectively which also are parallel to axes Y3 and Y4. The locking surfaces 82 and 83 are aligned generally orthogonal to the longitudinal axes of the latch arms 72 and 73 respectively.

The socket housing 62 is mateable with a plug having a housing 84. The plug housing 84 includes a forward mating end 85 and a locking cam 86 extending unitarily therefrom. The cam 86 is characterized by angularly aligned leading ramp faces 88 and 89 which are engageable with the leading ramp faces 78 and 79 of the latch arms 72 and 73 respectively. The interengagement of the ramp faces 88 and 89 of the cam 86 with the leading ramp faces 78 and 79 of the latch structure 70 causes the respective latch arms 72 and 73 to be resiliently deflected about axes Y3 and Y4 away from one another during the initial stages of mating. The cam 86 is further provided with rearwardly disposed locking faces 92 and 93 for locking engagement with the respective locking surfaces 82 and 83 of the latch arms 72 and 73 upon complete mating of the respective housings 62 and 84.

Figure 6:
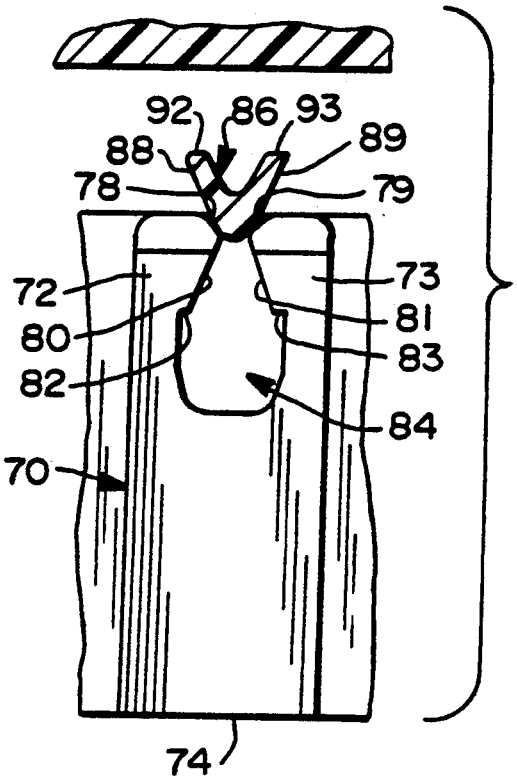
FIG. 6 is a cross-sectional view of the locking structures of FIGS. 4 and 5 in an aligned but unmated condition.
Figure 7:
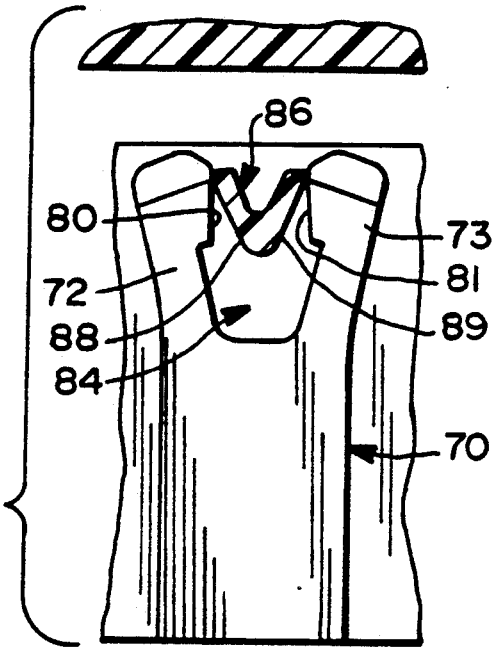
FIG. 7 is a cross-sectional view similar to FIG. 6 but showing the connector housings in a partly mated condition.
Figure 8:
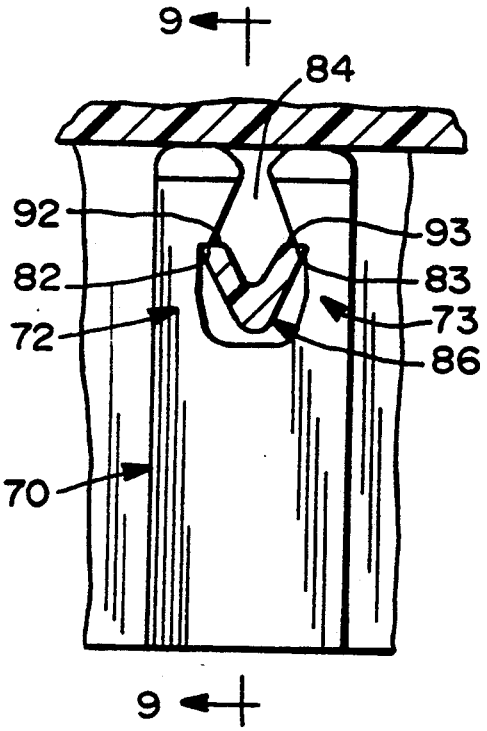
FIG. 8 is a cross-sectional view similar to FIGS. 6 and 7 but showing the respective connector housings in a fully mated condition.

The connector housings 62 and 84 are shown in FIGS. 6–8 during various phases of mating. In particular, the initial engagement of the leading ramp faces 78 and 79 of the latch structure 70 with the corresponding leading ramp faces 88 and 89 of the locking cam 86 causes the latch arms 72 and 73 to be resiliently deflected about axes Y3 and Y4 away from one another and into the deflected orientation shown in FIG. 7. As the respective housings 62 and 84 advance beyond the position shoWn in FIG. 7, the stored energy developed by the resilient deflection of the latch arms 72 and 73 in cooperation with the trailing ramp faces 80 and 81 of the latch arms 72 and 73 will be operative to urge the respective housings 62 and 84 into the fully mated condition shown in FIG. 8. In this fully mated condition, the latch arms 72 and 73 will resiliently return to their initial undeflected condition, as shoWn in FIG. 8, such that the rearwardly facing locking surfaces 82 and 83 on the latch arms 72 and 73 respectively will engage the corresponding locking surfaces 92 and 93 on the cam 86. It will be appreciated that the trailing ramp faces 80 and 81 which return the stored energy of the resilient latch arms 72 and 73 are disposed directly on the latch arms 72 and 73 in the embodiment of FIGS. 4–9, Whereas the corresponding trailing ramp faces 58 and 59 are provided directly on the cam 54 in the FIGS. 1–3 embodiment.

Figure 9:
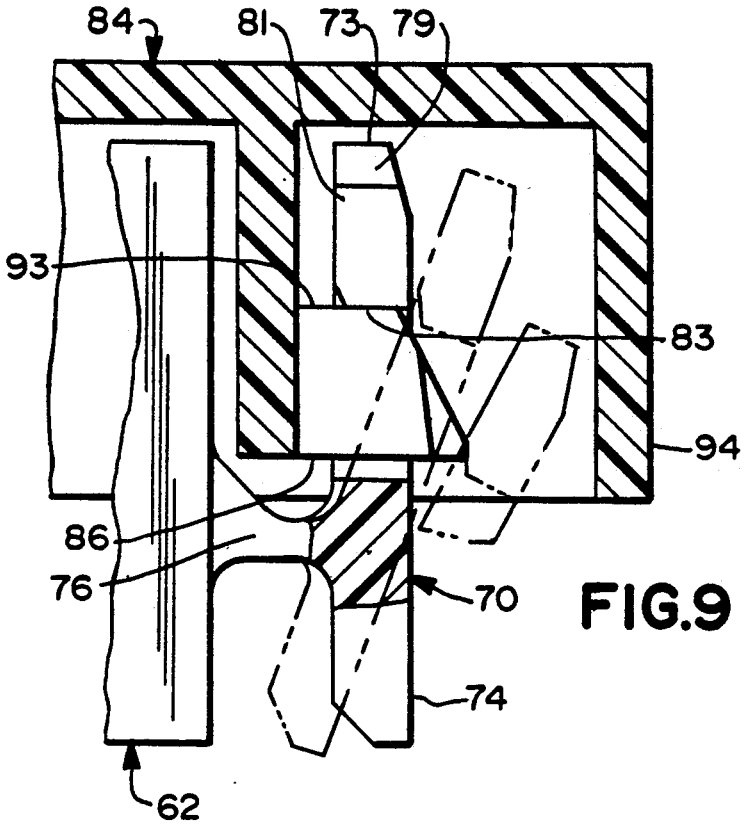
FIG. 9 is a cross-sectional view taken along line 9—9 in FIG. 8.

Turning to FIG. 9, the respective connector housings 62 and 84 can be disengaged by urging the rearward end 74 of the latch structure 70 toward the remainder of the housing 62. This downward pressure exerted on the rearward end 74 of the latch structure 70 will cause the latch arms 72 and 73 to be rotated aWay from the remainder of the housing 62 and to clear the locking faces 92 and 93 of the cam 86. The housing 62 can then readily be disengagad from the housing 84 by merely exerting forces sufficient to overcome the contact forces in the terminals (not shown). As shown in FIG. 9, over-stress or over-rotation of the latch structure 70 is prevented by an anti-overstress wall 94 on the housing 84. The anti-overstress wall will also make it difficult to achieve connection by deflecting latch structure 70 as shown in FIG. 9. In particular, the leading ends of the latch arms 72 and 73 Will be likely to engage the anti-overstress wall 94 to prevent this method of connection.

As With the previously described embodiment, the housings 62 and 84 are urged into a fully mated condition by rotation of latch arms 72 and 73 about first parallel axes Y3 and Y4, and disengagement of the connector housings 62 and 84 is achieved by rotation of the same latch structures about a different and orthogonally disposed axis X2. With both previously described embodiments, the respective positions of the ramps are such that it is unnecessary to exert substantial pushing forces to achieve full mating or to exert significant pulling forces to achieve unmating.

Figure 10:
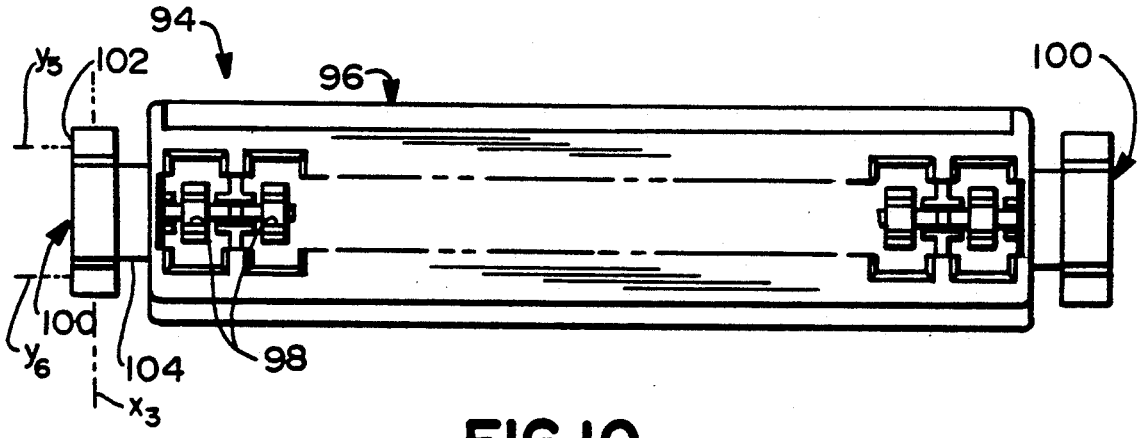
FIG. 10 is a front elevational view of a third embodiment of a connector in accordance with the subject invention.
Figure 11:
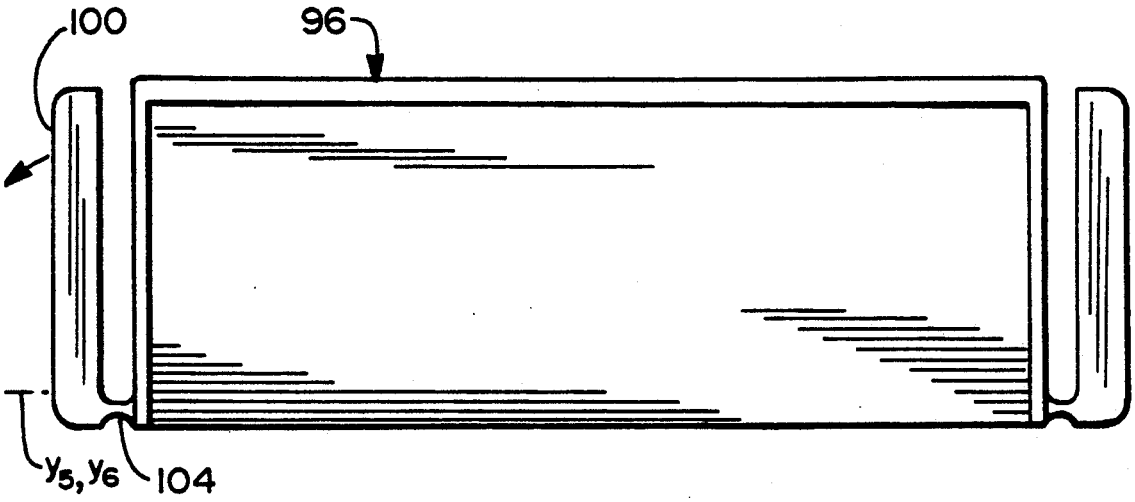
FIG. 11 is a side elevational view of the connector housing shown in FIG. 10.
Figure 12:
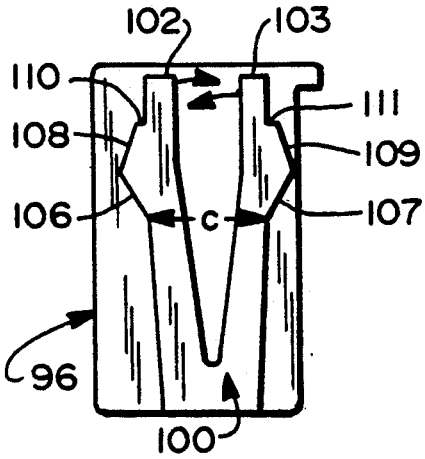
FIG. 12 is an end elevational view of the connector housing shoWn in FIGS. 10 and 11.

A further embodiment of the positive latch structure of the subject invention is illustrated in FIGS. 10–18. In particular, a connector plug 94 having a housing 96 and a plurality of terminal cavities 98 mounted therein is shown in FIGS. 10–12. The housing 96 is unitarily molded from a nonconductive material and comprises resiliently deflectable latch arm structures 100. As depicted in FIGS. 10–12, each latch arms structure 100 comprises a pair of resiliently deflectable latch arms 102 and 103 which are cantilevered from the remainder of the housing 96 by a root 104. Thus, the entire latch structure 100 is resiliently deflectable about axis X3 relative to the root 104 toward or away from the remainder of the housing 96. Additionally, the respective latch arms 102 and 103 are deflectable toward one another about axes Y5 and Y6.

The latch arms 102 and 103, as shown in FIG. 12, are provided with leading ramp surfaces 106 and 107 respectively, trailing ramp surfaces 108 and 109 and locking surfaces 110 and 111, all of which are generally parallel to axes Y5 and Y6 and which are disposed on the respective outwardly facing sides of the arms 102 and 103. The forward mating end of the leading ramp surfaces 106 and 107 define a minor width "c".

Figure 15:
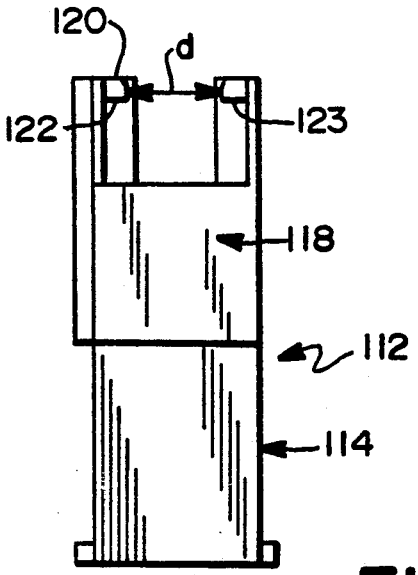
FIG. 15 is an end elevational view of the connector housing shown in FIGS. 13 and 14.
Figure 13:
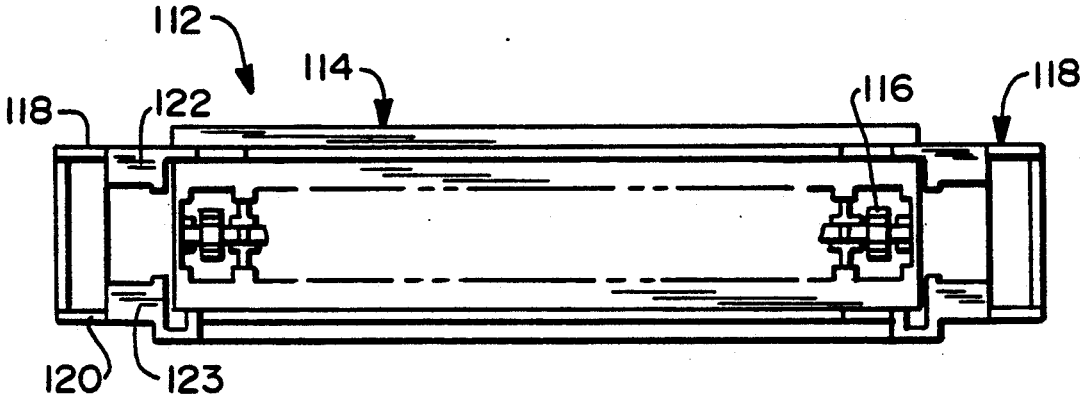
FIG. 13 is a front elevational view of a connector mateable With the connector shown in FIG. 10.
Figure 14:
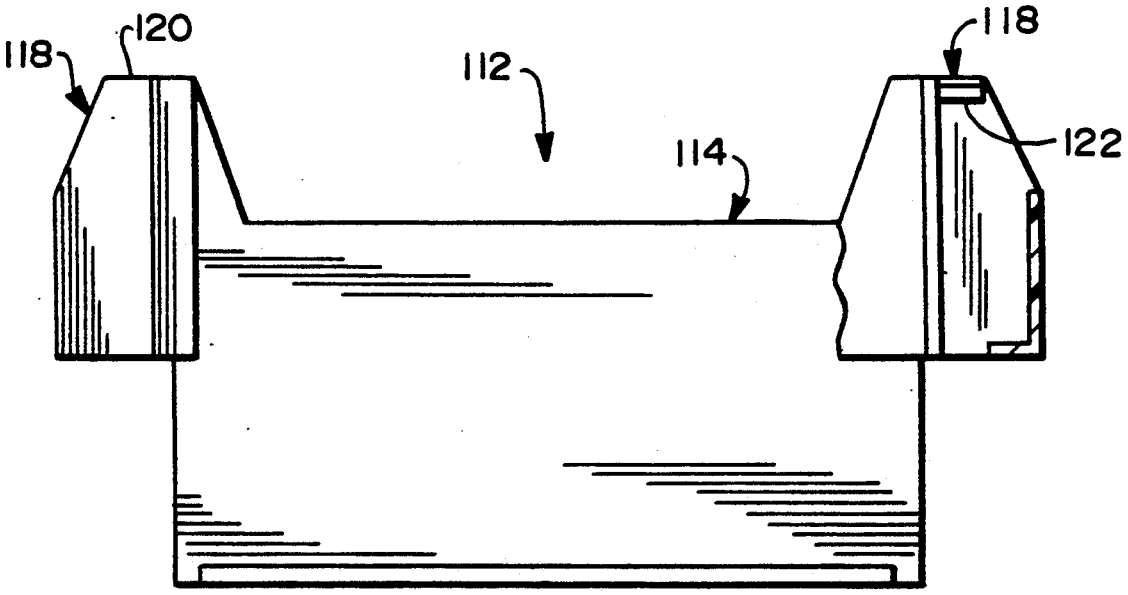
FIG. 14 is a top elevational view, partly in section, of the connector shown in FIG. 13.
Figure 16:
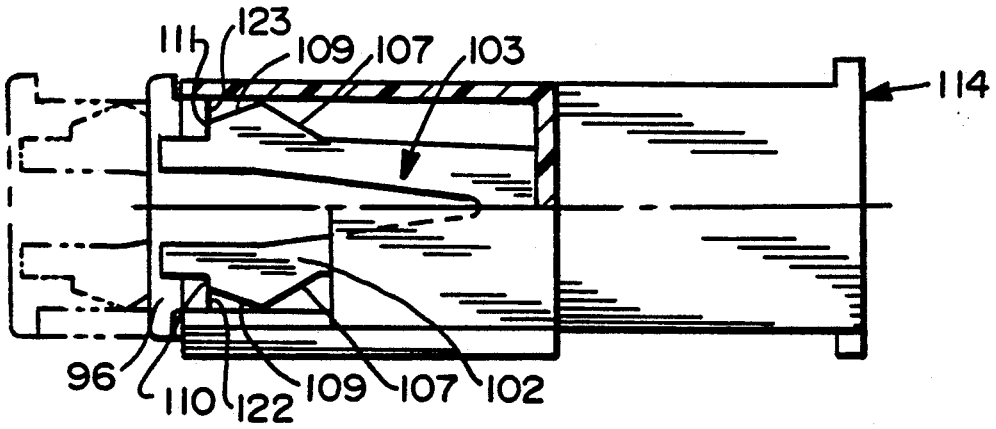
FIG. 16 is a cross-sectional view showing the connectors of FIGS. 10–15 prior to mating and also in a fully mated condition.

The plug connector 94 is mateable with a socket connector 112 which is shown in FIGS. 13–15. The socket connector 112 comprises a nonconductive housing 114 having a plurality of terminal cavities 116 disposed therein. The housing 114 further comprises locking gate structures 118 disposed on opposed ends thereof for camming and subsequent locking engagement with the respective latch structures 100 of the plug connector 94. Each locking gate structure 118 comprises a forward mating face 120 having a pair of spaced apart locking cam walls 122 and 123 respectively. The distance "d" between the locking cam walls 122 and 123 of the socket connector housing 114 is approximately equal to the minor distance "c" between the leading ramp surfaces 106 and 107 on the latch arms 102 and 103 nearest the root 104. As shown most clearly in FIGS. 16 and 17, the movement of the housings 96 and 114 toward one another urges the leading ramp surfaces 106 and 107 of the latch arms 102 and 103 respectively into the respective cam walls 122 and 123 of the gate structure 118. The ramping action caused by this contact urges the respective resilient latch arms 102 and 103 toward one another, thereby developing stored energy. After sufficient insertion of the plug housing 96 into the socket housing 114, the trailing ramp surfaces 108 and 109 of the latch arms 102 and 103 respectively will engage the respective cam walls 122 and 123. The angular alignment of the trailing ramp surfaces 108 and 109 enables the energy stored by the resilient deflection of the latch arms 102 and 103 to be used against the locking cam walls 122 and 123 to urge the respective housings 96 and 114 toWard a fully mated condition of the connectors. Upon full mating, the latch arms 102 and 103 will resiliently return to their undeflected condition such that the locking surfaces 110 and 111 thereof closely engage the locking cam walls 122 and 123 as shown most clearly in solid lines in FIG. 16.

Figure 18:
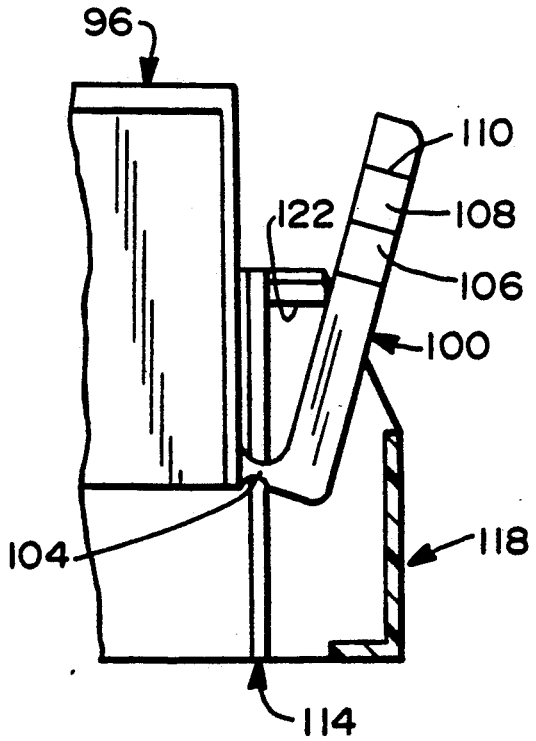
FIG. 18 is a cross-sectional view of the mated electrical connectors of FIGS. 16 and 17 during the unmating thereof.
Figure 17:
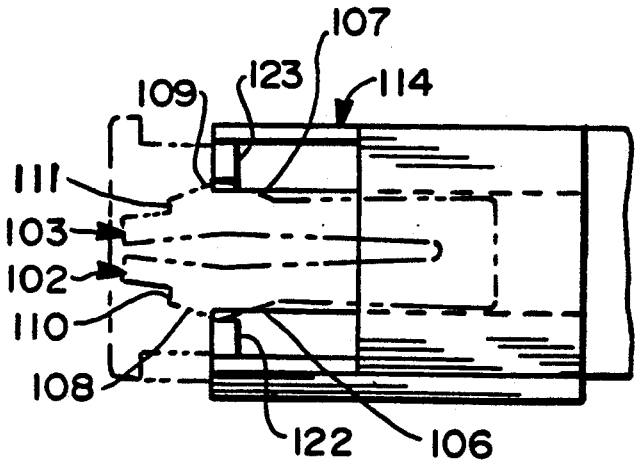
FIG. 17 shows the connectors of FIG. 16 at an intermediate mateable disposition relative to one another.

Disengagement of the respective connector housings 96 and 114 is achieved by rotating the latch structure 100 relative to the root 104 and about axis X3 away from remaining portions of the housing 96 such that the locking surfaces 110 and 111 clear the cam walls 122 and 123 as shown in FIG. 18. In this orientation, unmating can be achieved by merely exerting relative pulling forces sufficient to overcome the contact forces of terminals mounted in the housings 96 and 114.

Figure 19:
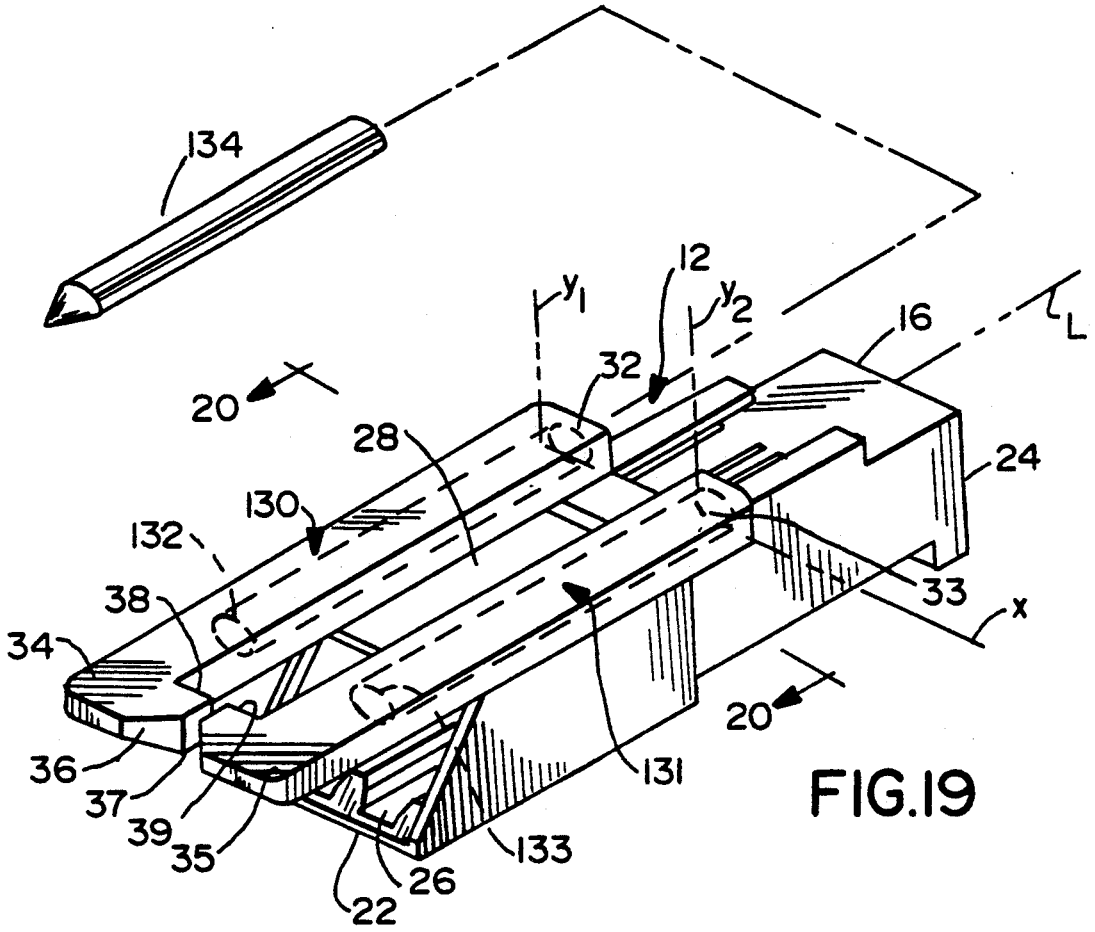
FIG. 19 is an exploded perspective view of the socket connector of FIG. 1 but showing wire inserts in the latch arms.

Referring now to FIG. 19, the socket connector 12 of FIG. 1 is shown having steel-reinforced latch arms 130 and 131. Two apertures 132 and 133 have been drilled or molded into the approximate centers of the respective rear ends 32 and 33 of the latch arms 130 and 131. A spring steel wire or pin 134 is then inserted into apertures 132 and 133 from the respective rear ends. Wire inserts 134 are preferably made from spring steel wire cut at the desired length and shaped at one end to facilitate insertion into the holes. In this embodiment, the wire inserts run generally parallel to the longitudinal mating axis "L" of the housing 16 and are aligned generally orthogonal to the axes Y1 and Y2. In this manner, the spring steel wire inserts 134 will generate additional stored energy when the latch arms 130 and 131 are deflected away from one another during initial insertion of the connectors. The wire inserts 134 will then release this stored energy during the final portion of connector insertion, thus assisting socket 12 to mate with its plug connector and urging the connector assembly to remain in a fully mated configuration.

Figure 20:
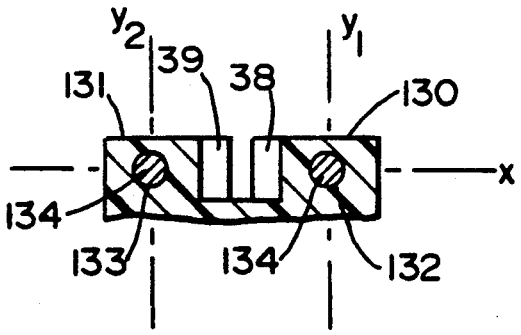
FIG. 20 is a cross-sectional view of the steel-reinforced latch arms taken along line XX—XX of FIG. 19.

FIG. 20 is a cross-sectional view of latch arms 130 and 131 taken along line XX—XX of FIG. 19. Note that the wire inserts 134 are located at the approximate center of the cross-section of each latch arm 130 and 131. Moreover, the wire inserts 134 have a circular cross-section such that they may be deflected in either the X or Y direction using the same amount of force. However, it is contemplated that for a different connector application, it may be desired that the latch arms present a different amount of deflection force in a particular direction. For example, in the connector assembly illustrated in FIG. 4, the latch arms 72 and 73 are deflected about axes $Y_3$ and $Y_4$ away from each other during mating of the connectors, while the entire latch structure 70 is deflected at the root 76 about axis $X_2$, not axis X, to permit unmating of the connector. In that case, the steel reinforcements may exhibit a rectangular cross-section to deflect only about axes $Y_3$ and $Y_4$. Moreover, such reinforcement strips may be affixed to the face or side of the latch arms as opposed to being inserted therein.

Figure 22:
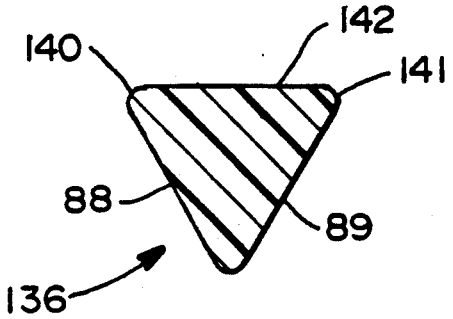
FIG. 22 is a cross-sectional view of an alternative embodiment of a mating cam for use with the latch of FIG. 21.
Figure 21:
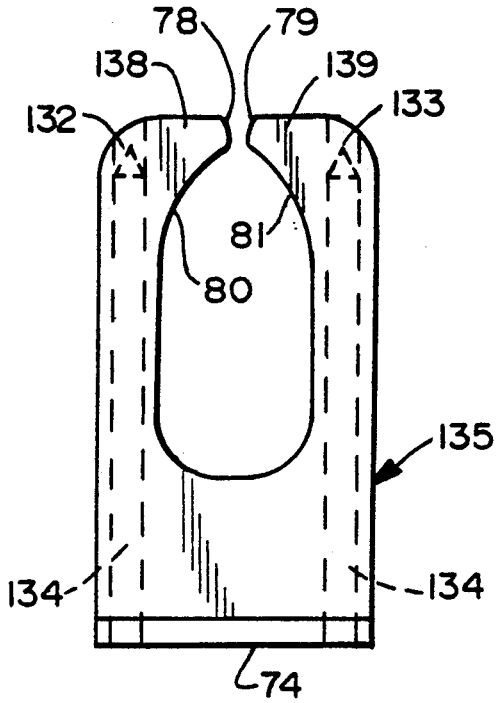
FIG. 21 is an end elevational view of an alternative embodiment of the reinforced locking structure which could be used with various connector housings.

FIGS. 21 and 22 illustrate the components of an alternative embodiment of a latch structure which can be used with the connector housings of FIGS. 4 or 10. The latch 135 of FIG. 21 mates with cam 136 of FIG. 22. However, in a different connector embodiment, the reinforced latch could be designed to mate with any type of catch mechanism. Note that the inside profile of latch 135 is different from that of latch 70 of FIG. 4. As shown in FIG. 21, latch 135 is constructed without any locking faces on the inside portion of the latch arms 138 and 139. It has been found that a locking mechanism is not always necessary when the steel reinforcements 134 are used in the latch arms. Once the locking surfaces (82 and 83) are removed, it is possible to optimize the inside profile of the latch arms in order to improve the sliding effect of the wedge-shaped cam 136. Latch arms 138 and 139 still include the leading ramp surfaces 78 and 79, and the trailing ramp surfaces 80 and 81. However, since the cam 136 noW has a triangular cross-section, the trailing ramp surfaces 80 and 81 have been constructed to exhibit a curvilinear profile so as to increase the connector pull-in force. The improved sliding effect is demonstrated in the next figures. Thus, instead of having a latching system to provide the repulsion to pull-in to locking effect, latch 135 provides a repulsion to pull-in effect, wherein the pull-in force remains after completion of the connector mating.

In the embodiment of FIG. 21, apertures 132 and 133 are shown to extend throughout the entire length of the latch arms 138 and 139. Depending on the application and the particular pull-in force desired for that connector, the length of the apertures 132 and 133 and/or the length of the wire insert 134 could be varied to provide for different pull-in forces. Moreover, an important feature of the invention is that wire inserts of different diameters can be used to accurately control the amount of pull-in force. This feature is extremely valuable when differing amounts of pull-in force are required depending upon the number of terminals used in the connector. For example, a ten-terminal connector may require much more mating force than a two-terminal connector. A wire insert having a larger diameter would then be used in the ten-terminal connector latch. The pull-in force can also be adjusted by utilizing wires having various spring tensions, or by adjusting the longitudinal position of wire insert 134 in the apertures 132 and 133.

Figure 23:
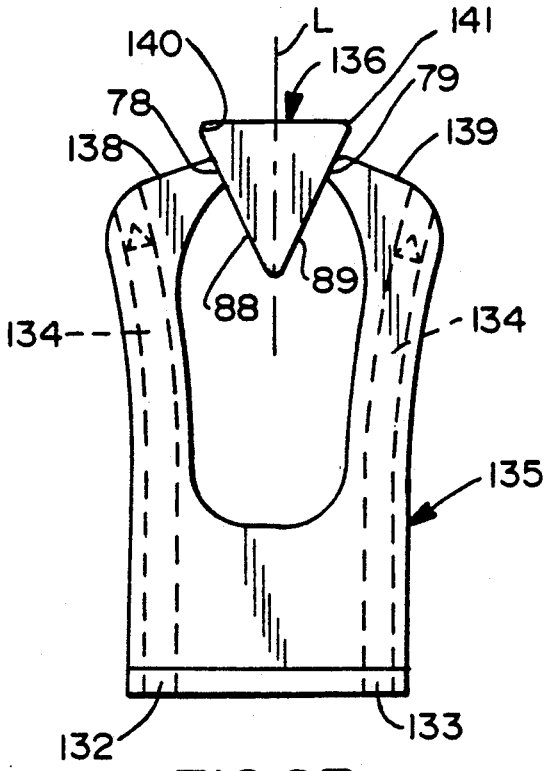
FIG. 23 is a cross-sectional view of the reinforced locking structures of FIGS. 21 and 22 in an aligned but unmated condition.
Figure 24:
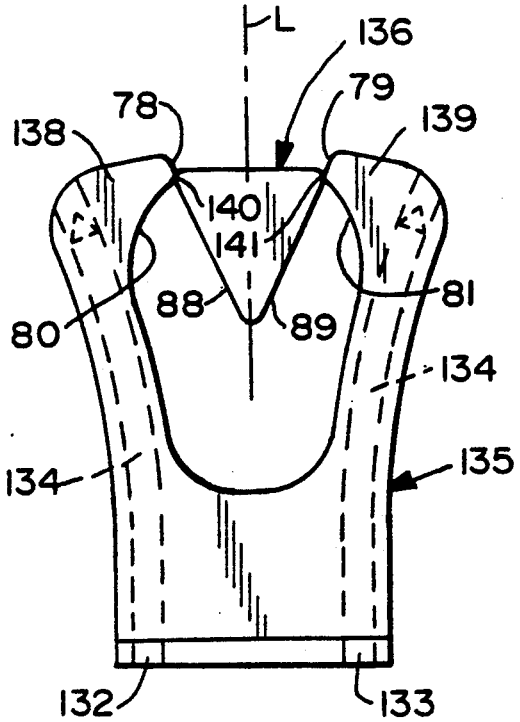
FIG. 24 is a cross-sectional view similar to FIG. 23 but showing the connector housings in a partly mated condition.
Figure 25:
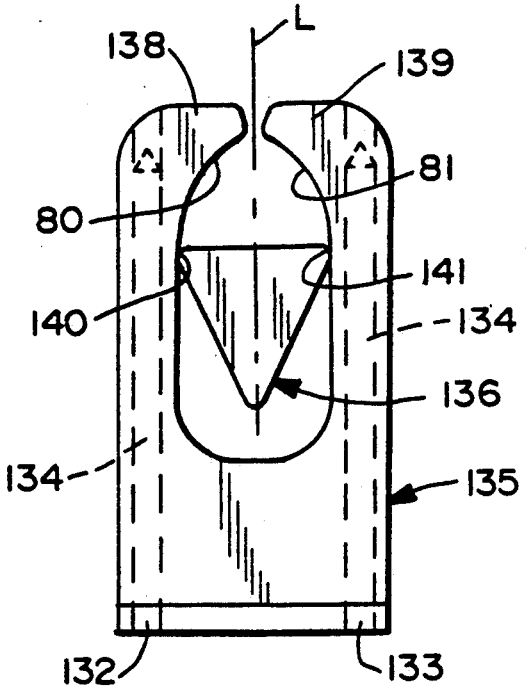
FIG. 25 is a cross-sectional view similar to FIGS. 23 and 24 but showing the respective connector housings in a fully mated condition.
Figure 26:
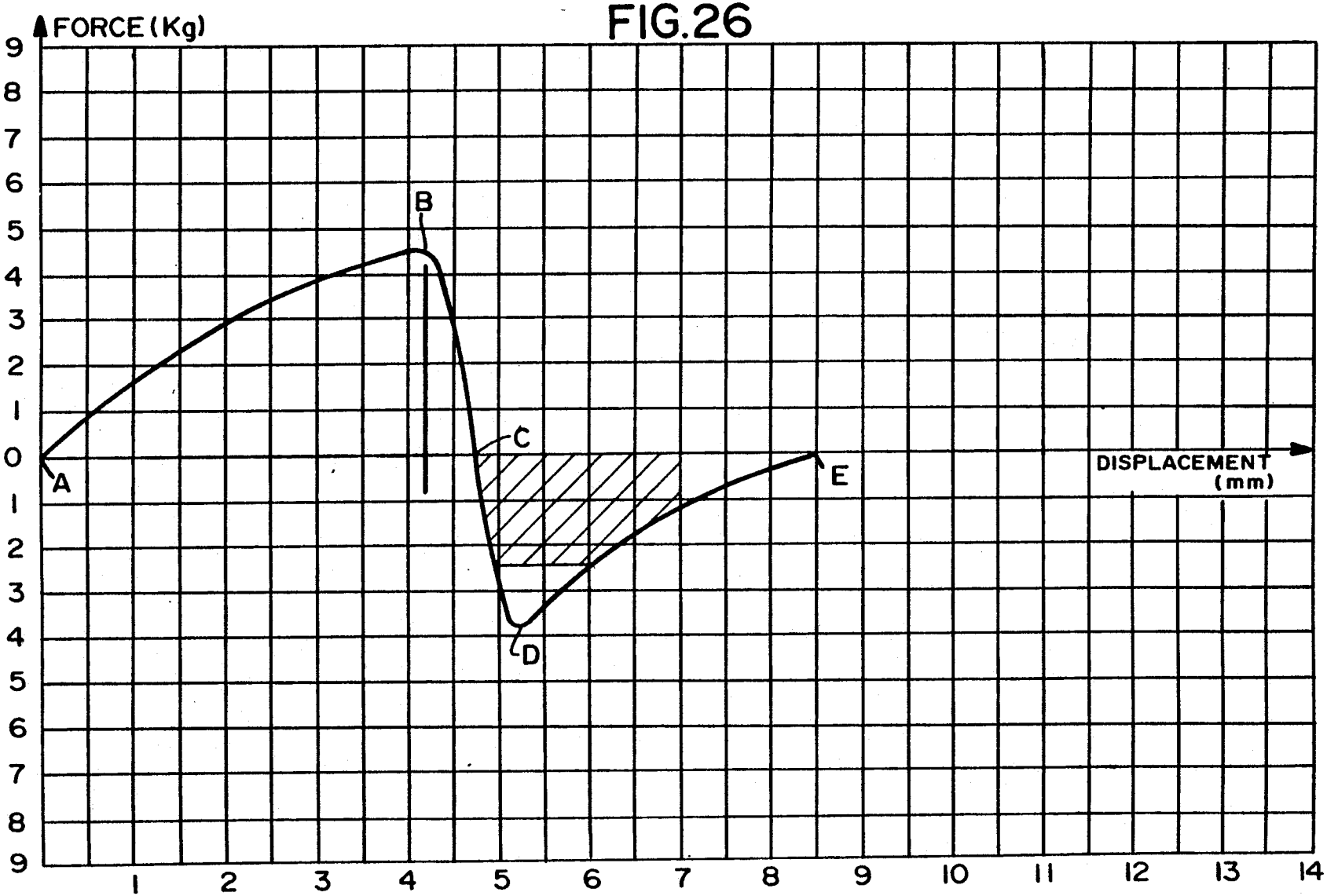
FIG. 26 is a graphical representation of the connector insertion force vs. displacement along the mating axis corresponding to FIGS. 23 to 25.

FIGS. 23 through 25 illustrate how cam 136 engages with latch 135 through the various phases of mating. The graph of FIG. 26, which corresponds with the mating phases of FIGS. 23 through 25, illustrates how the amount of insertion force varies with the amount of displacement of the connector assembly during mating. More specifically, FIG. 26 represents the amount of force in kilograms provided along the longitudinal mating axis L as a function of the displacement in millimeters of the wedge-shaped cam 136 along the L axis. This particular graph represents the behavior of an eight-terminal connector mated with a flexible printed circuit board having a thickness of 2.1 millimeters.

The portion of the curve A-B of FIG. 26 illustrates that a positive insertion force is required to overcome the repulsion effect of the cam 136 in the latch 135 during the first stages of mating, as illustrated in FIG. 23. Note that during this first stage of mating, the leading faces 78 and 79 of the latch arms contact the leading faces 88 and 89 of the wedge-shaped cam 136. Note also that the downward insertion force on cam 136 causes latch arms 138 and 139 to be resiliently deflected away from one another as energy is being stored in the latch arms, particularly in the wire inserts 134 located in apertures 132 and 133.

As the respective housings of the connector advance beyond the position shown in FIG. 23, a point is reached wherein the upper corners 140 and 141 of cam 136 slide from the leading surfaces 78 and 79 of latch 135 to the trailing surfaces 80 and 81. This position is illustrated in FIG. 24, and corresponds to the B-C-D portion of the graph of FIG. 26. Note that the repulsion effect changes to a pull-in effect at point C on the graph. Hence, the positive (repulsion) forces required to store energy in the latch arms become negative (pull-in) forces as the stored energy in the latch arms is released. It can also be seen from FIG. 26 that the connector terminals would not be fully engaged at point C, since there is a lack of pull-in force to urge the connector to remain in a fully mated condition.

FIG. 25 illustrates the cam 136 and the latch 135 in a fully mated condition. Accordingly, the D-E portion of the FIG. 26 graph illustrates that a negative (pull-in) force is provided by the latch arms as the cam moves from the position illustrated in FIG. 24 to that illustrated in FIG. 25. The stored energy in the latch arms 138 and 139, and particularly in the wire inserts 134, force the latch arms together as the upper corners 140 and 141 of the cam 136 slide down the trailing surfaces 80 and 81. As long as there is some curvature to the trailing surfaces, a residual pull-in force exists. Therefore, locking faces are not required in this embodiment due to the additional pull-in force provided by the wire inserts.

In the preferred embodiment, the cam surface 142 measures 6.8 millimeters (between corners 140 and 141), while the distance between the inside surfaces of latch arms 138 and 139 at their midpoint (beloW the curvature of surfaces 80 and 81) is 7.0 millimeters in the natural (unflexed) position. Apertures 132 and 133 measure 1.3 millimeters in diameter. Although the total height of the latch along the longitudinal mating axis L measures 20.8 millimeters, apertures 132 and 133 are drilled from the rear end 74 of the latch and extend only 19.5 millimeters into the latch arms. Accordingly, wire insert 134 is constructed from a 1.0 millimeter diameter spring steel wire which is cut to 19 millimeters in length and which has its upper end rounded or pointed for easier insertion. Latch 135 is preferably constructed of the same material as the connector housing, which, in the preferred embodiment, is nylon. Hence, the use of wire inserts in the latch arms prevents the nylon from being permanently deformed.

In summary, positive latch structures are provided for electrical connectors wherein at least one resilient deflectable latch arm and a corresponding locking cam structure for causing deflection of the latch arm during mating are provided. The latch arm is deflectable about an axis extending generally orthogonal to the direction of movement of the connectors during mating. The latch arm alternatively is deflectable about a second axis to disengage the latch arm and locked cam and to enable unmating without overcoming the various ramping forces encountered during mating. The latch and/or the associated cam for deflecting the latch are provided with a leading ramp surface for developing stored energy in the latch, a trailing ramp surface for employing the stored energy and achieving complete positive mating, and a locking surface for ensuring positive locking between the respective connectors. The latch arms may be provided in oppositely deflectable pairs. The ramping surfaces may be provided either on the latch arms or on the cam engaged by the latch arms. The latch arms may also be provided with spring steel wire inserts such that they do not become permanently deformed due to continuous loading, excessive temperatures, or aging.

The reinforced latch arms provide a continuous mating force, which can be adjusted by (a) changing the diameter of the wire inserts, or (b) varying the length of the wire inserts, or (c) varying the position of the inserts along the length of the latch arms, or (d) using spring steel wires having different spring tensions.

While the invention has been described with respect to certain preferred embodiments, it is apparent that various changes can be made without departing from the scope of the invention as defined by the appended claims. In particular, it should be noted that although each of the illustrated embodiments shows a generally symmetrical pair of deflectable latch arms, a single latch arm embodying the described features may alternatively be employed.

What is claimed is:

1. An improved latching means for assisting the mating of a connector assembly having first and second connectors adapted to be mated along a longitudinal mating axis, said latching means comprising:

at least one deflectable cantilevered latch arm constructed from a first material, said latch arm coupled to said first connector;

spring means, constructed from a second material comprising a steel wire insert running substantially throughout the length of said latch arm, for developing and releasing stored energy during the mating of said connectors, said second material being more resilient than said first material; and catch means, coupled to said second connector, for engaging and deflecting said latch arm during the mating of said connectors, whereby said latching means employs said stored energy in urging said connector to remain in a fully mated configuration.

2. The latching means according to claim 1, wherein said latch arm is constructed of plastic.

3. The latching means according to claim 1, wherein said catch means is constructed in the shape of a cam projecting from said second connector.

4. The latching means according to claim 1, wherein said latching means includes at least one pair of deflectable latch arms.

5. The latching means according to claim 1, wherein said latch arm is deflectable about a first axis of deflection lying substantially orthogonal to said longitudinal mating axis.

6. The latching means according to claim 5, wherein said latching means includes a leading ramp surface for deflecting said latch arm about said first axis and for developing stored energy in said spring means during at least an initial portion of the mating of said connectors.

7. The latching means according to claim 6, wherein said latching means includes a trailing ramp surface for releasing said stored energy of said spring means during at least a final portion of the mating of said connectors.

8. The latching means according to claim 7, wherein said leading and trailing ramp surfaces are disposed on said latch arm.

9. The latching means according to claim 7, wherein said leading ramp surface is disposed on said catch means, and said trailing ramp surface is disposed on said latch arm.

10. The latching means according to claim 5, wherein said latch arm is alternatively deflectable about a second axis of deflection angularly aligned with said first axis.

11. The latching means according to claim 10, wherein said second axis of deflection is generally orthogonal to said first axis of deflection and is generally orthogonal to said longitudinal mating axis.

12. The latching means according to claim 10, wherein said latch arm is coupled to said first connector by a root, said second axis of deflection lying substantially in said root, such that said latch arm is deflectable about said root to enable disengagement of said latch arm from said catch means for unmating said connectors.

13. The latching means according to claim 1, wherein said catch means is a cam of generally prismatic configuration and of generally triangular cross-section.

14. A pair of matable electrical connectors having a positive pull-in force in a fully mated condition of said connectors, said pair comprising first and second connectors, the first connector comprising at least one cantilevered latch resiliently and alternatively deflectable about a first axis of deflection, the second connector comprising a cam disposed for engagement with said latch during mating of said connectors, at least one of said latch and said cam comprising a leading ramp surface for deflecting said resilient cantilevered latch about said first axis of deflection thereof and for developing stored energy in said resilient latch, a trailing ramp surface for employing the stored energy of the resiliently deflected cantilevered latch and urging said connectors into a fully mated condition, said latch including resilient metallic spring means for providing reinforcement, whereby the resiliency of said latch is maintained over adverse conditions and wherein said latch is alternatively deflectable about a second axis of deflection to enable disengagement of said latch from said cam for facilitating unmating of said connectors.

15. The pair of matable electrical connectors according to claim 14, wherein at least one of said latch and said cam further comprises a locking surface for lockingly retaining said connectors in a fully mated condition.

16. A pair of mateable electrical connectors comprising a first connector and a second connector, the first connector comprising a pair of latch arms, each said latch arm being resiliently deflectable about a first axis towards and away from the other latch arm, said latch arms being alternatively deflectable about a second axis extending generally orthogonal to the first axis and lying substantially in a root which unitarily connects said latch arms to said first connector, each said latch arm including a spring steel reinforcement extending generally throughout said latch arm, the second connector in said pair comprising a generally prismatically configured cam, said cam comprising a pair of leading ramp surfaces for deflecting said latch arms about said first axis and for developing stored energy in said latch arms, said pair of latch arms comprising a pair of trailing ramp surfaces for employing the stored energy of the resiliently deflected latch arms and for urging said connectors into a fully mated condition, the leading ramp surfaces and the trailing ramp surfaces being aligned generally parallel to the first axes of said latch arms, whereby the resilient deflection of said latch arms about said second axis enables disengagement of said latch arms from said cam for enabling unmating of said connectors.

* * * * *